United States Patent [19]

Krüger

[11] 4,266,709

[45] May 12, 1981

[54] ADVANCE DRIVE MEANS FOR A PIPE SNAKE

[75] Inventor: Burkhard Krüger, Cologne, Fed. Rep. of Germany

[73] Assignee: Myers-Europe Pumpen GmbH, Essen, Fed. Rep. of Germany

[21] Appl. No.: 46,683

[22] Filed: Jun. 8, 1979

[30] Foreign Application Priority Data

Jun. 8, 1978 [DE] Fed. Rep. of Germany ..... 2825228

[51] Int. Cl.[3] ..... B65H 17/22; B65H 51/10

[52] U.S. Cl. ..... 226/181; 254/134.3 FT

[58] Field of Search ..... 226/181; 34, 124, 143; 242/54 R; 15/104.3 R, 104.3 SN; 254/134.3 FT

[56] References Cited

U.S. PATENT DOCUMENTS

| | | | |
|---|---|---|---|
| 3,387,759 | 6/1968 | Stedman | 226/181 |
| 3,451,089 | 6/1969 | Carlson et al. | 15/104.3 |
| 3,887,163 | 6/1975 | Prange | 254/134.3 FT |

*Primary Examiner*—Leonard D. Christian

*Attorney, Agent, or Firm*—Burns, Doane, Swecker & Mathis

[57] ABSTRACT

A mechanism for displacing a pipe snake comprises a roller set of at least two opposite rollers adapted to roll against the pipe snake and being reversible such that they selectively advance or retract the pipe snake. Also provided is an eccentric drive which periodically imparts to the pipe snake longitudinal hammering movements in a direction opposite that in which the snake is being displaced to facilitate travel of the snake.

10 Claims, 10 Drawing Figures

ADVANCE DRIVE MEANS FOR A PIPE SNAKE

The invention relates to an advance drive means for a pipe snake, comprising a roller set of at least two rollers adapted to roll off the pipe snake opposite each other and being reversible such that they selectively advance or retract the pipe snake.

A pipe snake in the present context refers to an elongated, preferably elastic, resilient structure of substantially constant cross section suitable to be introduced into a tubular line or a bore so as to clean the same or treat it in another manner from the inside. The term pipe snake thus comprises coil spring-like helices of metal or plastics wire as well as hoses by means of which a fluid under pressure can be supplied to a tool disposed at the end of the hose. In certain cases, e.g. for cleaning straight tubes of heat exchangers a substantially rigid lance may be used instead of a hose. Therefore, a lance is also intended to be embraced by the term pipe snake. The tool provided at the end of the hose or lance, for instance, may be a nozzle head directing the fluid in one or more strong jets against the interior wall of the pipe line or bore, or it may be a drilling tool which is driven and/or cooled by the fluid.

In a known advance drive means of the kind described initially, known from U.S. Pat. No. 3,451,089, comprising a single set of rollers which consists of two rollers, these two rollers are supported on a roller carrier which surrounds a drum, rotatably supported inside the roller carrier, in the manner of a yoke and which is itself pivotally supported in a frame to swing about an axis intersecting the axis of rotation of the drum at right angles. The drum contains a pipe snake embodied by a wire helix which is guided toward the outside through a funnel-shaped outlet extending in axial direction away from the drum and between the rollers supported on the roller carriers. At its free end the wire helix carries a pipe cleaning tool. The pivotability of the roller carrier has no other purpose than to adjust the axial direction of the drum and thus the direction at which the pipe snake will leave the drum. The rollers have a neutral position at which their axes of rotation extend parallel to the pipe snake which is guided between them. In this neutral position the rollers are opposed to longitudinal movement of the pipe snake when the drum, together with the pipe snake, is caused to rotate by a motor associated with the drum. Starting from the neutral position the rollers can be positioned obliquely, selectively in two different directions, by the same amounts yet in opposite senses. Without being driven directly themselves, the rollers thus can enforce an advance or retraction of the pipe snake passing between them, at a given direction of rotation of the drum and the pipe snake, depending on the direction of the inclination of the rollers.

With this known advance drive means a change of the oblique position of the rollers does permit the advance movement of the pipe snake to be converted in simple manner into a retraction movement and vice versa. Thus, for example, a pipe length in which the tool mounted at the pipe snake meets with an obstacle can be passed several times without having to reverse the direction of rotation of the drum. Yet it is not possible to impart to the tool fixed to the pipe snake a hammering or pulsating longitudinal movement during a more or less slow advance or retraction.

The invention, on the other hand, is based on the finding that a hammering or pulsating additional movement superimposed over the advance or retraction movement of a pipe snake can considerably increase the effect of tools of the most different kinds mounted on the pipe snake. This applies above all to the effect of water jets of high pressure exiting from a nozzle head at the end of a hose or lance-shaped pipe snake. Obviously, the improvement of the effect is due to the fact that reciprocating movements in rapid succession of the nozzle head or other pipe cleaning tool contribute to the quick discharge of impurities which the tool has removed from the pipe wall. On the other hand, it is an established fact that pipe cleaning tools, such as above all nozzle heads supplied with water under high pressure cannot be moved back and forth for any desired length of time at a certain place in a pipeline or bore without damaging the interior wall of the pipeline or bore. Finally, it must be taken into consideration that the changes of the direction of movement which are desired to follow each other rapidly with a view to the effectiveness of the tool disposed at the pipe snake should not subject the pipe snake to excessive stress in order not to reduce its lifetime noticeably. If, in the case of the known advance drive means described, the rollers were reversed in cycles of short consecutive order, the pipe snake would be destroyed quickly, at least if it were a high pressure hose.

It is, therefore, the object of the invention to provide an advance drive means for a pipe snake suitable, at little expenditure, to impart to the pipe snake hammering or pulsating movements which are superimposed in gentle manner during an advance or retraction movement of certain average speed.

This object is met, in accordance with the invention, in an advance drive means of the kind described initially in that an additional drive means is associated with the pipe snake to impart to the same periodic longitudinal movements at least in that direction which is opposed to the advance or retraction produced by the roll-off motion of the rollers mentioned. In preferred embodiments of the invention at least one of the rollers is adapted to be driven in rotation by a roller drive motor. The roller drive motor makes it possible to impart to the pipe snake an advance or retraction movement, also without any rotation of the pipe snake. Consequently a rotatable drum for the pipe snake is not needed. For this reason alone the advance drive means according to the invention can have a simple design, and this has the further advantage that it can be transported easily. The invention, however, can be used also with an advance drive means with which the advance or retraction movement proper consists in turning about its own axis the pipe snake, preferably embodied by a lance, and, thereby, screwing it between inclined rollers, as with the known advance drive means. At any rate, the additional drive means imparts to the pipe snake a periodic additional movement which is at least almost rectilinear and the frequency and amplitude of which depend on the design of the additional drive means and, therefore, are adjustable to the respective case of application.

Furthermore, the invention may take advantage of the feature of the known advance drive means according to which the rollers are supported on a roller carrier which is pivotable at a frame about an axis which extends at least approximately at right angles with respect to the pipe snake guided between the rollers. In this case, however, according to the invention the pipe snake is guided between the rollers at a spacing from the pivot axis of the roller carrier, and the additional drive means is an eccentric or crank drive means driven by the roller drive motor and swinging the roller carrier back and forth periodically. With this embodiment of the advance drive means according to the invention the purpose of the pivotability of the roller carrier is not an adjustment of the pipe snake in a certain direction. Instead, the roller carrier is pivoted back and forth so as to give the rollers and thus the pipe snake the desired periodic additional movement. Any minor changes in direction of the pipe snake which occur during pivoting movements about an axis which is disposed at a finite distance may be left disregarded, provided the pivot angle is not too great. In practice, pivot angles will be sufficient at which the aditional movement of the pipe snake can still be considered to be approximately rectilinear.

The embodiment of the invention as described last further may make use of the feature of the known advance drive means according to which the roller drive motor is fixed to the roller carrier and the axes of rotation of the rollers extend at an angle to the pivot axis of the roller carrier. In this case a further development of the invention provides for a wheel disposed coaxially with the roller which is driven by the roller drive motor. This wheel is in engagement with a pinion of smaller diameter supported on the roller carrier and drives a crank pin through this pinion. The crank pin in turn is connected by a connecting rod to a pin fixed to the frame.

Another further development of the embodiment including the pivotal roller carrier resides in that the roller drive motor is fixed on the frame and drives a wheel whose axis of rotation coincides with the pivot axis of the roller carrier, and in that one of the rollers is in gear-type power transmitting connection with this wheel. This further development has the advantage that the inert mass of the roller carrier is particularly small, a circumstance contributing substantially to smooth running and a long lifetime of the advance drive means according to the invention.

The further development of the invention described last may be realized in an especially simple manner in that the wheel is a friction wheel and the rollers are each supported on a pivot pin which extends parallel to the axis of rotation of the wheel and which is guided at the roller carrier so as to be radially displaceable with respect to the wheel and is also biased toward the wheel. Yet the wheel may also be a gear and may mesh with a pinion firmly connected with the one roller. A particularly simple embodiment with which the wheel is secured on the driven shaft of a step down gear train mounted on the frame and the roller carrier is rotatably supported on the same driven shaft is suitable above all for pipe snakes which are not too heavy.

For all embodiments with the movable roller carrier the maximum speed of the reciprocating motion of the roller carrier preferably is greater than the speed at which the rollers roll off on the pipe snake. In this manner the advance movement of the pipe snake is not only accelerated or decelerated periodically but also converted, temporarily, into a retraction movement. Inversely, a gradual retraction movement of the pipe snake is not only accelerated or decelerated by the additional reciprocating movement but also converted periodically into an advance movement.

In the case of the embodiments described above the additional movement of the pipe snake is produced by reciprocating movement of the roller carrier. According to another embodiment of the invention, however, it is provided that the additional drive means comprises a second set of rollers consisting of at least two rollers adapted to roll off on the pipe snake. These rollers can be driven in synchronism with the rollers of the first set of rollers in a direction of rotation in which they tend to move the pipe snake in opposite direction to the direction of advance of the first set of rollers. In this particular embodiment it is further provided that the rollers of the first set of rollers have a contact surface adapted to roll off on the pipe snake only in a first angular range, while the rollers of the second set of rollers have a contact surface adapted to roll off the pipe snake only in a second angular range which is at least almost complementary to the first angular range and of different size. This embodiment is characterized by particularly smooth running because all the rollers can rotate steadily and no other mass need be provided which must be accelerated and decelerated periodically.

With this last embodiment the rollers preferably are firmly connected with a gear each and are in nonslip gear-type power transmitting connection with each other through these gears.

Embodiments of the invention will be described below, by way of example, with reference to the accompanying diagrammatic drawings in which.

Figure 1:
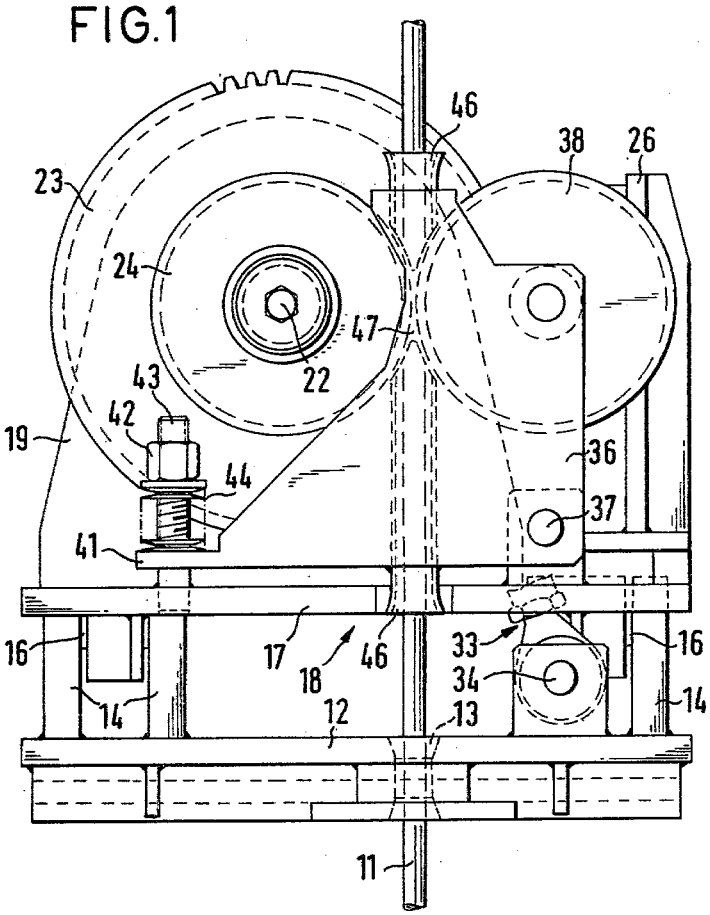
FIG. 1 is a front elevational view of a first advance drive means in the direction of arrow I in FIG. 2.
Figure 2:
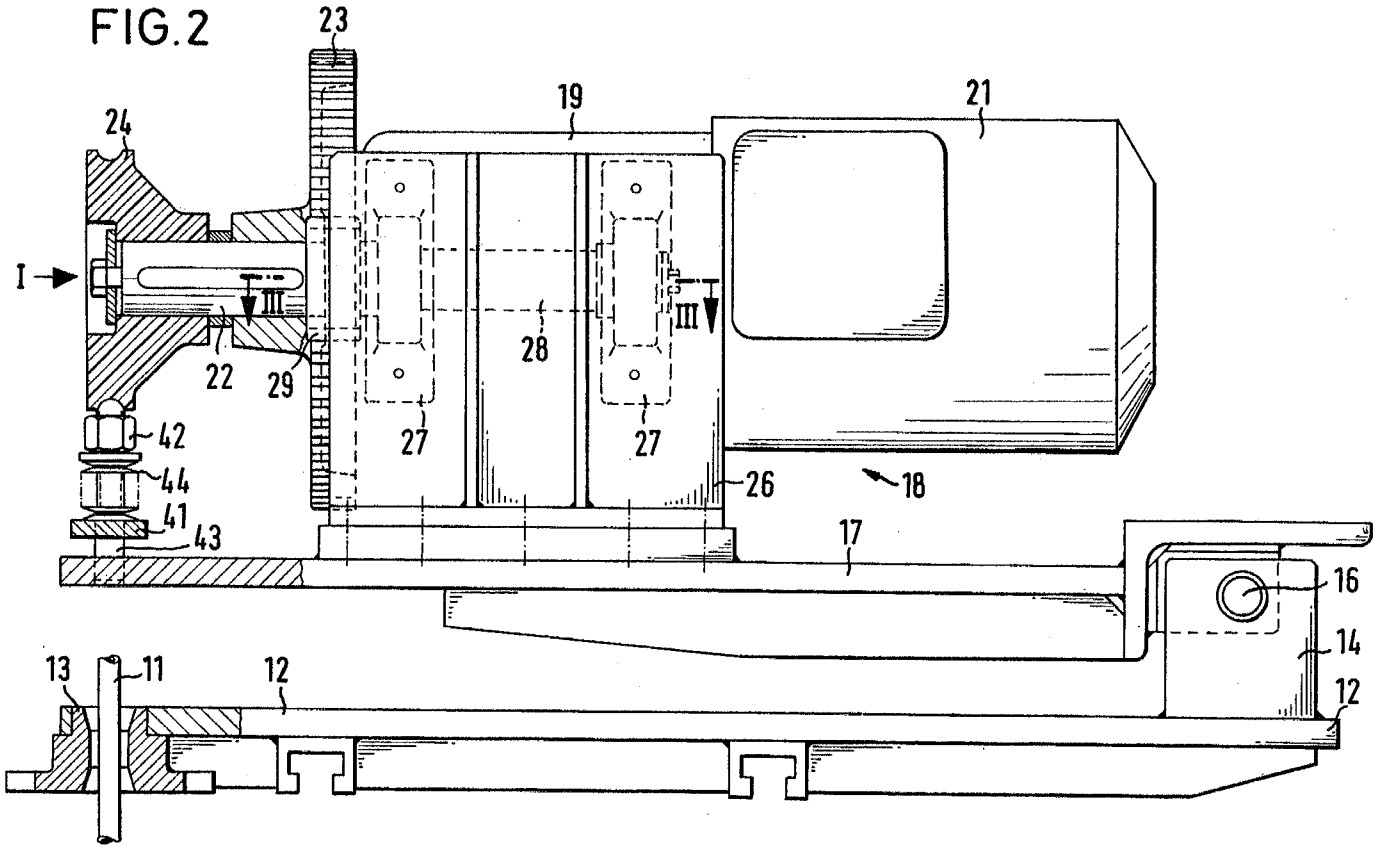
FIG. 2 is a corresponding side elevational view, partly in section in the plane II—II of FIG. 3.
Figure 3:
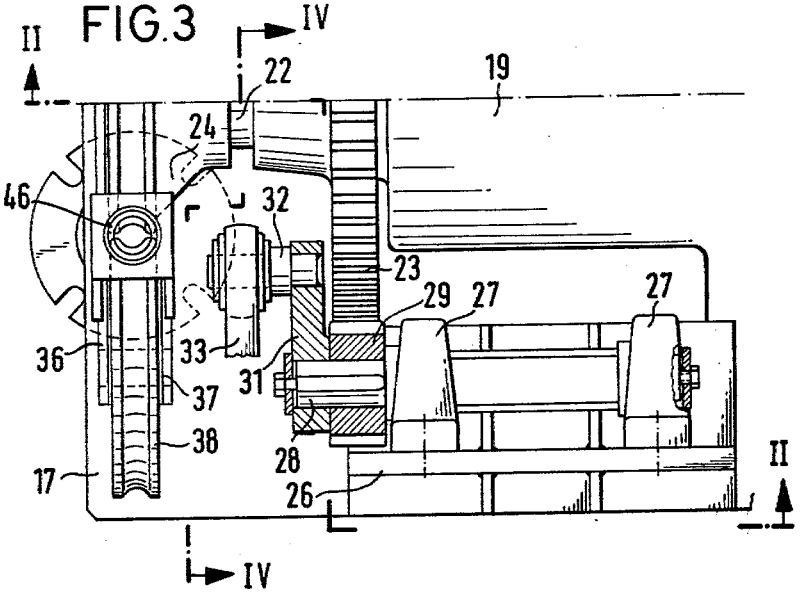
FIG. 3 is a top view of part of the first advance drive means, partly as a sectional view along line III—III of FIG. 2.
Figure 4:
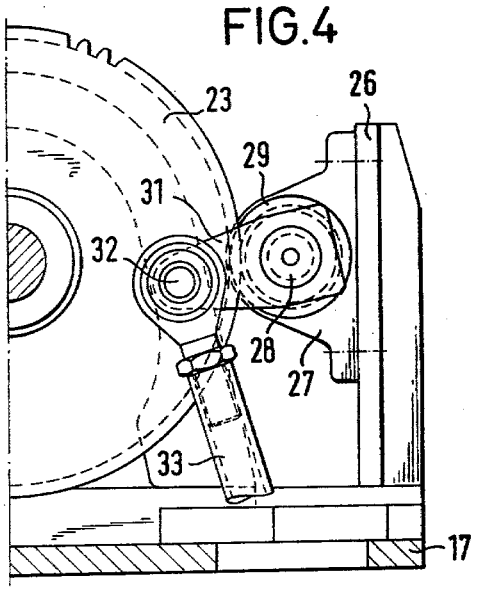
FIG. 4 is a sectional view along line IV—IV of FIG. 3.

Is is the function of the advance drive means shown in FIGS. 1 to 3 to selectively effect the advance of a pipe snakell, for instance in vertical downward direction, or the retraction thereof, for instance in vertical upward direction, simultaneously imparting to the pipe snake a repriprocating additional movement at high frequency. The advance drive means comprises a frame 12 to which a lower guide tube 13 for the pipe snake 11 is secured. The frame 12 may be arranged, for example, on the pipe plate of a boiler whose pipes are to be cleaned. The frame 12 may be mounted on a carriage, a slide or the like so as to permit easy and accurate displacement of the advance drive means into different positions at which the guide tube 13 will be aligned with any particular pipe to be cleaned. This mounting may also be such that the guide tube 13 is positioned obliquely or horizontally, then the pipe snake 11 will be advanced and retracted at a corresponding inclination with respect to the vertical.

A stub 16 disposed at right angles with respect to the guide tube 13 and spaced from the same is supported in bearing blocks 14 which are fixed to the frame 12. A rocking beam 17 is supported on the stub 16 and belongs to a part of the advance drive means hereinafter designated roller carrier 18 which is adapted to reciprocate relative to the frame 12. The rocking beam 17 carries a step down gear train 19 to which a roller drive motor 21 is connected by way of flanges. The step down gear train 19 provides a step down ratio which, preferably, is infinitely variable between the roller drive motor 21 and a driven shaft 22 on which a gear 23 and a roller 24 are fixed.

The rocking beam 17 further carries a bracket 26 comprising two bearing blocks 27. A crankshaft 28 extending parallel to the driven shaft 22 is supported in the bearing blocks 27. A pinion 29 meshing with gear 23 and a crank 31 are secured on the crankshaft 28. The crank 31 includes a crank pin 32 supporting a connecting rod 33 which is adjustable in length in the manner of a tie bar and connects the crank pin 32 with a pin 34 secured to the frame 12.

Also disposed on the rocking beam 17 is a clamping jaw 36 which is supported for pivoting movement about a stub 37 disposed parallel to the driven shaft 22. The clamping jaw 36 supports a roller 38 whose axis is likewise parallel to the driven shaft 22. In shape and size roller 38 corresponds to roller 24. Both rollers 24 and 38 are made of plastics and formed as pulleys so as to be suitable to carefully guide and drive the coiled pipe 11.

The necessary friction lock between the rollers 24 and 38 and the pipe snake 11, required to drive the pipe snake 11 is produced by a spring pile 44 clamped between a projection 41 at the clamping jaw 36 and a nut 42 screwed on a threaded bolt 43 which is fixed to the rocking beam 17.

In accordance with FIG. 1 the pipe snake 11 additionally may be guided in an upper guide tube 46 fixed to the clamping jaw 36 and formed with a clearing 47 to permit the rollers 24 and 38 to abut against the pipe snake 11.

The advance drive means described operates as follows: When the roller drive motor 21 is switched on such that it will rotate roller 24 in clockwise direction, as seen in FIG. 1, the pipe snake 11 will be displaced in downward direction. At the same time, gear 23 meshing with pinion 29 drives the crankshaft 28 and the latter, together with crank 31 and connecting rod 33, constitutes an additional drive which rocks the rocking beam 17 back and forth about stub 16 whereby additional movement, substantially vertically up and down, is imparted to rollers 24 and 38. This movement is almost rectilinear as the rollers are located at a relatively great distance from the stub 16, and it is superimposed over the rotation of the rollers. Thus the pipe snake 11 undergoes additional upwards and downwards motion while being advanced in downward direction. The greatest speed of the additional movement occurring between the upper and lower deadcenter of the rocking motion of the rocking beam 17 is greater by a multiple than the advance movement caused by rotation of the rollers 24 and 38 since the transmission ratios between gear 23 and pinion 29, on the one hand, and between pinion 29 and crank pin 32, on the other hand, each are in the order of 1:2.

Figure 5:
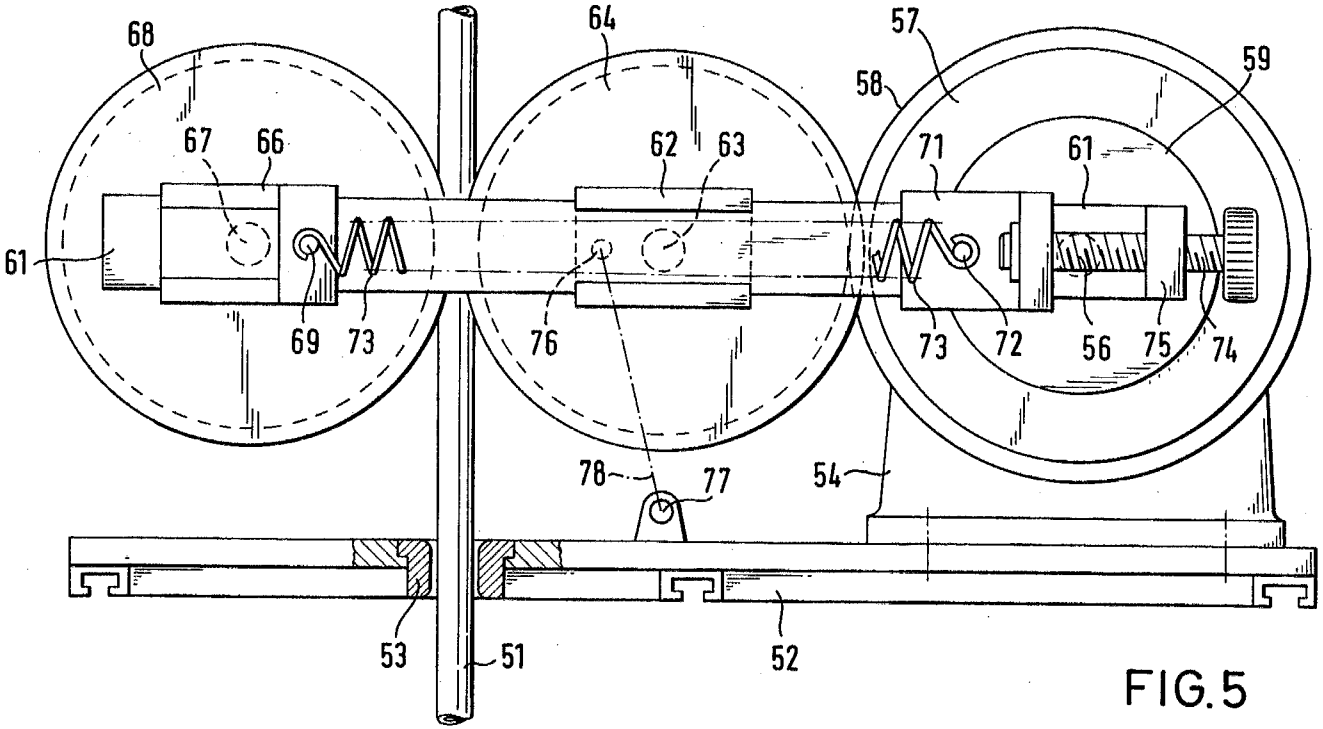
FIG. 5 is a front elevational view of a second embodiment of an advance drive means in the direction of arrow V in FIG. 6.
Figure 6:
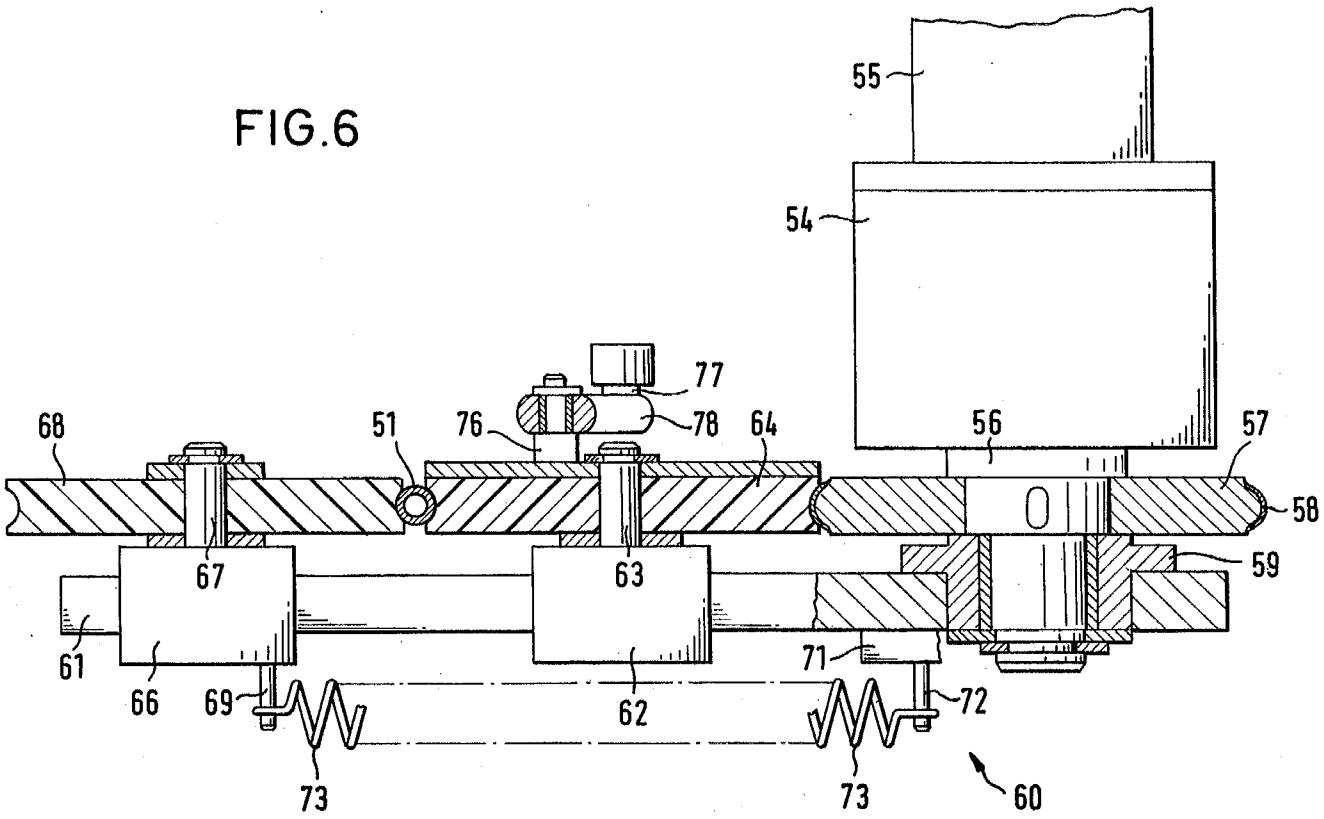
FIG. 6 is a corresponding top view.

The advance drive means for a pipe snake 51 shown in FIGS. 5 and 6 comprises a frame 52 which may also be provided with a movable carriage (not shown). Yet this advance drive means is of such light weight structure that it may readily be carried to its operating site. A guide tube 53 for the pipe snake 51 and a step down gear train 54 with a roller drive motor 55 connected to the same by way of flanges are secured on the frame 52. The step down gear train 54 has a driven shaft 56 on which a friction wheel 57 is fixed which comprises a race ring 58 of convex outline. Furthermore, a disc 59 is supported for free rotation on the driven shaft 56. Disc 59 serves as the carrying structural element of a roller carrier 60 which is pivotal with respect to the frame 52.

The roller carrier 60 further comprises a rocking beam 61 fixed to the disc 59 and designed as a radial guide means relative to the driven shaft 56. A first roller slide 62 is displaceable on the rocking beam 61, and a first pivot pin 63 disposed parallel to the driven shaft 56 is fastened to the roller slide 62. A first roller 64 disposed in overhung arrangement on the pivot pin 63 has a profile of the shape of a pulley and frictionally engages the pipe snake 51, on the one hand, and the friction wheel 57, on the other hand, as a satellite. As shown, preferably the diameter of the first roller 64 is smaller than the diameter of the friction wheel 57.

Moreover, a second roller slide 66 is guided on the rocking beam 61 so as to be displaceable radially with respect to the driven shaft 56. The guide means formed for this purpose on the rocking beam 61 preferably is the same as the one on which the first roller slide 62 is displaceable as well. A second pivot pin 67 extending parallel to the driven shaft 56 is fixed to the second roller slide 66. A second roller 68 is disposed on the second pivot pin 67 in overhung arrangement. An attaching pin 69 is fixed to the second roller slide 66 at the side remote from the second roller 68.

Finally, a third slide, hereinafter designated spring slide 71 is guided on the rocking beam 61 in a direction radial to the driven shaft 56. An attaching pin 72 interconnected with the attaching pin 69 of the second roller slide 66 by a tension spring 73 is fixed to the spring slide 71. The tension spring 73 exerts a force directed toward the driven shaft 56 on the second roller slide 66, and by this force the second roller 68 presses against the pipe snake 51. The pipe snake 51 in turn presses by the same force against the first roller 64, thus establishing and maintaining a connection in friction lock between the pipe snake 51 and the first roller 64, on the one hand, and between the first roller and the friction wheel 57, on the other hand.

The force of the tension spring 73 is adjustable by means of a set screw 74 which extends in longitudinal direction of the rocking beam 61, is in threaded engagement with a projection 75 formed at the rocking beam, and is supported at the spring slide 71 in such manner that it will carry along the latter.

A crank pin 76 whose eccentricity may be adjustable is fixed to the first roller 64 so as to extend parallel to the pivot pin 63 thereof. The crank pin 76 is linked by a connecting rod 78 to a pivot pin 77 fixed at the frame 52.

When the roller drive motor 55 causes rotation of friction wheel 57 in clockwise direction, as seen in FIG. 5, by way of the step down gear train 54, the friction wheel will rotate the first roller 64 in anti-clockwise sense, thus moving the pipe snake 51 in downward direction. At the same time the rotation of the first roller 64 produces an up and down swinging movement of the entire roller carrier 60 by way of the crank pin 76 and the connecting rod 78. This results in an additional upward and downward motion of the pipe snake 51.

Figure 7:
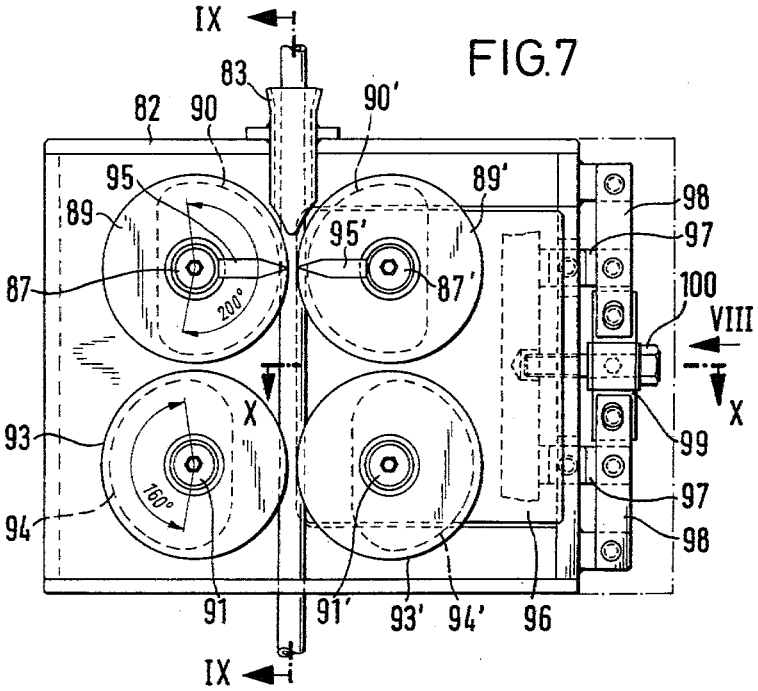
FIG. 7 is a front elevational view of a third embodiment of an advance drive means.
Figure 8:
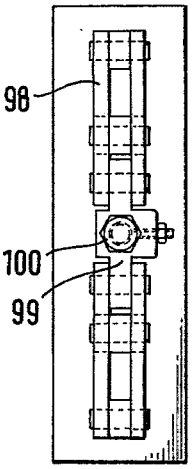
FIG. 8 is a corresponding side elevational view in the direction of arrow VIII of FIG. 7.
Figure 9:
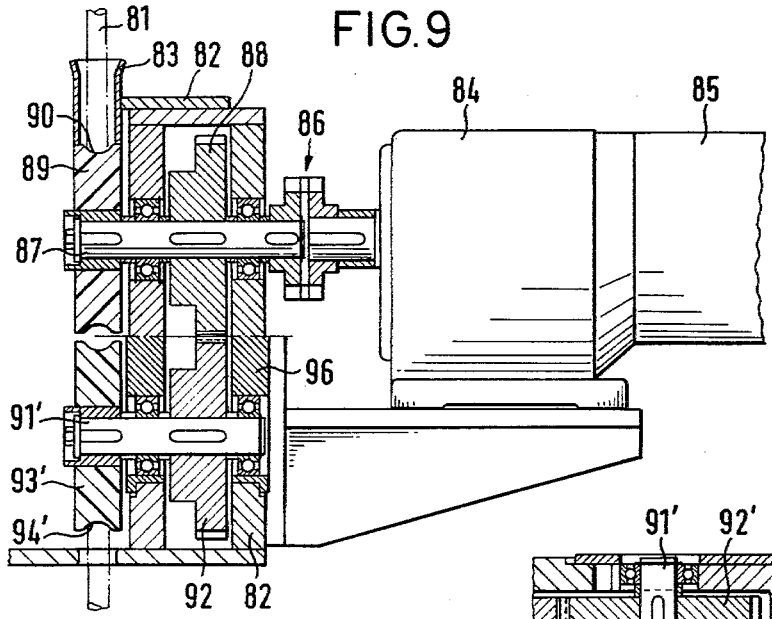
FIG. 9 is a sectional view along line IX—IX of FIG. 7.
Figure 10:
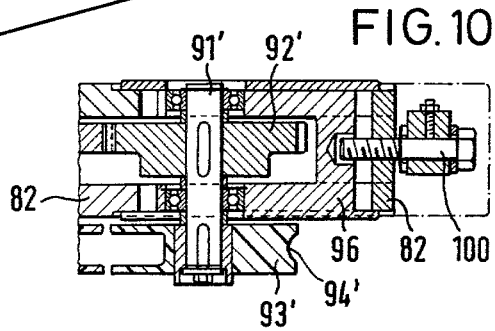
FIG. 10 is a sectional view along line X—X of FIG. 7.

The advance drive means shown in FIGS. 7 to 10 for a pipe snake 81 comprises a box-shaped frame 82 to which a guide tube 83 for the pipe snake is fixed. Also fixed to the frame 82 is a step down gear train 84 to which a roller drive motor 85 is connected by way of flanges. A coupling 86 which is shown in the form of a simple flange coupling but might also be a slipping clutch, connects the step down gear train 84 with a shaft 87 supported in the frame and being the left shaft, as seen in FIG. 7, of a first pair of parallel shafts 87, 87' arranged symmetrically relative to the pipe snake 81. A gear 88 and 88' each of a first pair of gears and a roller 89 and 89' each of a first roller pair are secured on the shafts 87 and 87', respectively. The rollers 89 and 89' each have a contact surface 90 and 90', respectively, extending only through 200°, in accordance with FIG. 7.

Perpendicularly below shaft 87 the left shaft, as seen in FIG. 7, of a second pair of parallel shafts 91, 91' is supported in the frame 82, the right shaft 91' of the pair being disposed perpendicularly below the right shaft 87' of the first pair of shafts. A gear 92 and 92' each and a roller 93 and 93' each are secured on the shafts 91 and 91', respectively. The rollers 93 and 93' each have a contact surface 94 and 94', respectively, extending only through 160 angular degrees.

Gears 88 and 88' mesh with each other and gear 88 also meshes with gear 92 disposed vertically below it, while gear 88' also meshes with gear 92' disposed vertically below this gear. In this manner all the shafts 87, 87', 91 and 91' are synchronized and rollers 89, 89', 93 and 93' fixed on the same also rotate in synchronism such that, at one direction of rotation of the roller drive motor 85, the rollers 89 and 89' of the upper roller pair tend to move the pipe snake 81 in downward direction, whereas the rollers 93 and 93' of the lower roller pair tend to move the pipe snake in upward direction. The opposite applies when the direction of rotation of the roller drive motor 85 is reversed. The angular position of rollers 89, 89', 93, 93' is so selected that both rollers 89 and 89' will always be in simultaneous frictional engagement with the pipe snake 81 by their contact surfaces 90 and 90', respectively. And this will only be the case when the contact surfaces 94 and 94' of the rollers 93 and 93' release the pipe snake, as follows from FIG. 7. As the angular zones of 200° of the contact surfaces 90 and 90', on the one hand, are complementary to the angular zones of 160° of the contact surfaces 94 and 94', on the other hand, in other words add up to 360°, the above also applies vice versa. This means that contact surfaces 94 and 94' will not be in frictional engagement with the pipe snake 51 unless contact surfaces 90 and 90' release the pipe snake and not otherwise. A pointer 95 and 95' each is seen attached to each roller 89 and 89' to indicate the conditions of the respective engagement.

The shafts 91 and 91' are not supported directly in the frame 82 but instead in a slide 96 guided in the frame 82 for displacement at right angles to the common plane of the shafts in question. The slide 96 is hingedly connected by a lug 97 each, supported at the slide, with two levers 98 supported at the frame 82. The two levers 98 in turn are hingedly connected, with clearance in their longitudinal direction, to a transverse bar 99 which is adjustable by means of a set screw 100 screwed into the frame and rotatably supported in the transverse bar. This makes it possible to adjust the spacing between rollers 89 and 89', on the one hand, and rollers 93 and 93', on the other hand, such that the rollers can grip the pipe snake 81 in friction lock between them. The variation of the engagement ratios of the gears 88 and 88' involved with each adjustment is acceptable since it is unimportant.

When the roller drive motor 85 is switched on in that direction of rotation which will effect clockwise rotation of roller 89, the pipe snake 81 is alternatingly moved downwards by a distance of, for instance, 100 mm corresponding to the arc length of contact surfaces 90 and 90' and then upwards by a distance of, for instance, 80 mm corresponding to the arc length of contact surfaces 94 and 94', then again downwards by 100 mm, etc. With the example of figures chosen, the resulting downward movement for each complete rotation of the rollers thus is 20 mm. If the direction of rotation of the rollers 89, 89' and 93, 93' is reversed, the resulting upward movement will amount to 100 mm, as opposed to downward movements of 80 mm each so that for each complete rotation of the rollers the pipe snake 81 will be moved upwards by 20 mm.

What we claim is:

1. An advance drive means for a pipe snake, comprising a roller set of at least two rollers adapted to roll off the pipe snake opposite each other and being reversible such that they selectively advance or retract the pipe snake, characterized in that an additional drive means is associated with the pipe snake to impart to the pipe snake periodic longitudinal movements at least in that direction which is opposed to the advance or retraction produced by the roll-off motion of the rollers.

2. An advance drive means as claimed in claim 1, characterized in that at least one of the rollers is adapted to be driven in rotation by a roller drive motor.

3. An advance drive means as claimed in claim 2 with which the rollers are supported on a roller carrier which is pivotal on a frame about an axis which extends at least approximately at right angles with respect to the pipe snake guided between the rollers, characterized in that the pipe snake is guided between the rollers at a spacing from the pivot axis of the roller carrier and the additional drive means is an eccentric or crank drive means driven by the roller drive motor and periodically swinging the roller carrier back and forth.

4. An advance drive means as claimed in claim 3 with which the roller drive motor is fixed to the roller carrier and the axes of rotation of the rollers extend at an angle with respect to the pivot axis of the roller carrier, characterized in that a wheel is arranged coaxially with the roller driven by the roller drive motor and engages a pinion of smaller diameter supported on the roller carrier and, by way of this pinion, drives a crank pin which is connected by a connecting rod to a pin fixed at the frame.

5. An advance drive means as claimed in claim 3, characterized in that the roller drive motor is fixed on the frame and drives a wheel whose axis of rotation coincides with the pivot axis of the roller carrier, and in that one of the rollers is in gear-type power transmitting connection with said wheel.

6. An advance drive means as claimed in claim 5, characterized in that the wheel is a friction wheel and the rollers are supported on a pivot pin each which extends parallel to the axis of rotation of the wheel and is guided at the roller carrier so as to be displaceable radially with respect to the wheel and is biased toward the wheel.

7. An advance drive means as claimed in claim 5, characterized in that the wheel is secured on the driven shaft of a step down gear train fixed on the frame and the roller carrier is supported for rotation on the same driven shaft.

8. An advance drive means as claimed in claim 1, characterized in that the maximum speed of the reciprocating motion of the roller carrier is greater than the speed at which the rollers roll off on the pipe snake.

9. An advance drive means as claimed in claim 2, characterized in that the additional drive means comprises a second set of rollers of at least two rollers adapted to roll off the pipe snake and to be driven in synchronism with the rollers of the first set of rollers in a direction of rotation in which they tend to move the pipe snake contrary to the advance direction of the first set of rollers, and in that the rollers of the first set of rollers each have a contact surface which is adapted to roll off on the pipe snake in a first angular range only, while the rollers of the second set of rollers each have a contact surface adapted to roll off the pipe snake only in a second angular range which is at least approximately complementary to said first angular range and of different size.

10. An advance drive means as claimed in claim 9, characterized in that the rollers are firmly connected with a gear each and are in nonslip gear-type power transmitting connection with each other through these gears.

* * * * *